US007914208B2

(12) United States Patent
Sprehe

(10) Patent No.: US 7,914,208 B2
(45) **Date of Patent: *Mar. 29, 2011**

(54) RECLOSABLE FASTENER STRIP

(75) Inventor: Gregory S. Sprehe, Carterville, IL (US)

(73) Assignee: Com-Pac International, Inc., Carbondale, IL (US)

( * ) Notice: Subject to any disclaimer, the term of this patent is extended or adjusted under 35 U.S.C. 154(b) by 846 days.

This patent is subject to a terminal disclaimer.

(21) Appl. No.: 11/122,355

(22) Filed: May 5, 2005

(65) Prior Publication Data

US 2005/0251973 A1 Nov. 17, 2005

Related U.S. Application Data

(63) Continuation-in-part of application No. 10/054,203, filed on Nov. 13, 2001, now Pat. No. 6,954,969, which is a continuation-in-part of application No. 09/524,439, filed on Mar. 14, 2000, now Pat. No. 6,576,278.

(51) Int. Cl.
*B65D 33/16* (2006.01)
*A44B 19/00* (2006.01)

(52) U.S. Cl. ..... 383/63; 383/59; 24/30.5 R; 24/585.12

(58) Field of Classification Search ..... 383/63, 383/64, 59; 24/399, 400, 30.5 R, 384, 585.12
See application file for complete search history.

(56) References Cited

U.S. PATENT DOCUMENTS 2,558,367 A 6/1951 Madsen
2,637,085 A 5/1953 Madsen
2,772,469 A 12/1956 Staller
2,780,261 A 2/1957 Svec
2,794,227 A 6/1957 Dorman
2,797,463 A 7/1957 Dorman
2,805,973 A 9/1957 Klasing et al.
2,823,720 A 2/1958 Svec
3,117,874 A 1/1964 Horan
3,173,184 A 3/1965 Ausnit
3,181,583 A 5/1965 LIngenfelter
3,204,855 A 9/1965 Boynton
3,325,084 A 6/1967 Ausnit
3,440,696 A 4/1969 Staller
3,672,122 A 6/1972 Berger et al.

(Continued)

FOREIGN PATENT DOCUMENTS

DE 37 27 321 3/1989

(Continued)

*Primary Examiner* — Jes F Pascua
(74) *Attorney, Agent, or Firm* — Vedder Price PC

(57) ABSTRACT

A reclosable fastener strip for securing to a film web comprises first and second elongated profile strips having interlocking hooks, recesses and protuberances. Each hook, as extruded, has a half arrowhead-shaped tip, a concave or partial-concave tail, and a generally upstanding neck connecting the tip and tail. Each recess has a base with a pair of generally upstanding neck elements disposed on opposite ends of the base. The base does not extend laterally beyond the neck elements. Each protuberance, as extruded, has a rounded tip, a concave or partial-concave tail, and a generally upstanding neck portion connecting the tip and tail. The profile strips are readily secured to the web without entrapping air between the profile strips and the film web and form an vacuum tight seal. The interlocking hooks, recesses and protuberances are sized, constructed and arranged to provide a vacuum tight seal upon interconnection thereof.

31 Claims, 6 Drawing Sheets

U.S. PATENT DOCUMENTS 3,742,950 A 7/1973 Endrody
3,776,408 A 12/1973 Wald
3,790,017 A 2/1974 Fitzpatrick et al.
3,822,806 A 7/1974 Grimes
3,846,209 A 11/1974 Howard
4,201,299 A 5/1980 Bumgarner et al.
4,238,040 A 12/1980 Fitzpatrick
4,339,046 A 7/1982 Coen
4,430,070 A * 2/1984 Ausnit ..... 493/215
4,466,547 A 8/1984 Klittich
4,501,585 A 2/1985 Friedman
4,523,377 A 6/1985 Spletzer et al.
4,558,792 A 12/1985 Cabernoch et al.
4,600,104 A 7/1986 Yanase
4,617,683 A 10/1986 Christoff
4,629,524 A * 12/1986 Ausnit ..... 156/66
4,673,383 A 6/1987 Bentsen
4,686,814 A 8/1987 Yanase
4,711,359 A 12/1987 White et al.
4,731,911 A 3/1988 Gould
4,736,451 A 4/1988 Ausnit
4,869,912 A 9/1989 McCoy et al.
4,919,983 A 4/1990 Fremin
4,923,701 A 5/1990 VanErden
4,944,418 A 7/1990 Wallace
D310,417 S 9/1990 Herritz
D315,601 S 3/1991 McCoy et al.
5,020,680 A 6/1991 Bale
5,067,822 A 11/1991 Wirth et al.
5,167,657 A 12/1992 Patel
5,272,794 A * 12/1993 Hamatani et al. ..... 24/586.1
5,276,950 A 1/1994 Johnson
5,356,222 A 10/1994 Kettner et al.
5,385,251 A 1/1995 Dunn
5,403,094 A 4/1995 Tomic
5,435,864 A 7/1995 Machacek
5,509,734 A 4/1996 Ausnit
5,839,831 A 11/1998 Mazzocchi
5,983,965 A 11/1999 Patrick
6,004,032 A 12/1999 Kapperman et al.
6,050,432 A 4/2000 Koehnke
6,185,796 B1 2/2001 Ausnit
6,305,844 B1 * 10/2001 Bois ..... 383/64
6,328,082 B1 12/2001 Lafond
6,481,890 B1 * 11/2002 VandenHeuvel ..... 383/64
6,487,758 B2 * 12/2002 Shaffer et al. ..... 24/585.12
6,954,969 B1 * 10/2005 Sprehe ..... 24/399
7,052,181 B2 * 5/2006 Smith et al. ..... 383/64

FOREIGN PATENT DOCUMENTS

EP 0332 341 9/1989

* cited by examiner

RECLOSABLE FASTENER STRIP

RELATED APPLICATION DATA

This application is a continuation-in-part application of Ser. No. 10/054,203 filed on Nov. 13, 2001 entitled "Reclosable Fastener Strip," now U.S. Pat. No. 6,954,969, which is a continuation-in-part of Ser. No. 09/524,439 filed on Mar. 14, 2000 entitled "Reclosable Baby Bottle Liner and Baby Bottle having Reclosable Liner," now U.S. Pat. No. 6,576,278 and all assigned to the same assignee, Com-Pac International, Inc.

TECHNICAL FIELD

The present application generally relates to a reclosable fastener for resealably closing a bag such as a baby bottle liner and more specifically to a fastener comprising a plurality of interlocking hooks, recesses and bulbous protuberances dimensioned and arranged to create a substantially vacuum tight seal for such bags.

BACKGROUND

Plastic film bags with reclosable fasteners are in widespread use in many industries and the home. The separable and reclosable fastener provides a convenient means for access into the bag and allows the bag to be reused.

Nursing pouches and disposable baby bottle liners provide a convenient way for nursing, working mothers to provide nourishment and sustenance for newborns and growing babies. Current baby bottle liners do not provide a way to safely store breast milk while minimizing the risk of external contamination of the milk, and internal bacterial growth. One such exemplary prior art baby bottle and liner is disclosed in U.S. Pat. No. 5,385,251 ("the '251 patent"). The '251 patent describes a baby bottle liner that provides a reclosable feature at one end of the liner. A serious drawback of this prior art patent involves the risk of contamination of the contents of the liner at the ends of the reclosable fastener and through the fastener itself. The liner of the '251 patent permits contamination by microbes through the sides of the fastener which are open to the environment. Further, the fastener itself permits air and water to enter the inside of the liner and contaminate the contents thereof. Consequently, a nursing mother may be feeding her child breast milk that may be contaminated with microbes which could cause serious gastrointestinal problems for the child.

Further, the prior art does not solve the problem of how to place an airtight, watertight or vacuum tight reclosable string fastener on a liner that is of a size of most liners for baby bottles. Conventional baby bottle liners are generally narrow in width. Hence, placement and sealing of a reclosable fastener onto a liner of narrow width is also a serious problem.

Reclosable fasteners have been the subject of considerable development throughout the years, as is evidenced by the volumes of patents covering these devices. A common reclosable fastener construction consists of a single rib and corresponding groove assembly. The rib terminates into a generally asymmetric arrowhead-shaped, member commonly referred to as the male end of the fastener. The corresponding groove, commonly called the female end of the fastener, ordinarily consists of walls terminating into hooks for grabbing the rib and interlocking the fastener.

This construction offers many advantages, as well as disadvantages. For instance, the fastener elements can be easily and economically manufactured by extrusion methods. The fastener is also securely retained in the closed position to discharge of contents of the bag. The flanges readily open from the outside by applying a separating force on the pull flanges extending from the mouth of the bag. The key disadvantage of the single rib and groove construction is that unless the fastener components have a certain size or stiffness and are manufactured to closely adhere to strict tolerances, the fastener elements are difficult to align and interlock and do not provide an airtight, watertight, or vacuum tight seal.

The above disadvantages have been overcome by constructing a separable fastener with a plurality of interlockable hook-shaped ribs that can be small in size and are composed of a relatively soft and resiliently flexible material that can be aligned and interlocked by simple inward pressure. However, this construction requires at least one of ribs to be hinged to the bag wall to prevent the fastener from opening by internal pressure, yet still does not achieve a vacuum tight seal. Therefore, a first aspect of the present invention is to provide a reclosable fastener having the advantage of multi-rib and groove construction to facilitate alignment and interlocking engagement of fastener elements and which provide a substantially vacuum tight seal.

Another aspect of the present invention is to provide a reclosable fastener which provides ample resistance to internal separating forces without requiring complex structures manufactured into the fastener elements.

A further aspect of the present invention is to provide a substantially flangeless reclosable fastener that is both substantially watertight and airtight and yet small in size, which reduces plastic usage and cost and allows use of watertight reclosable fasteners in relatively small flexible containers.

SUMMARY OF THE INVENTION

The present invention pertains to a reclosable fastener that resealably closes a bag. The bag includes opposing panels, each having an inner surface, and the fastener is adapted to be affixed to the upper portions of the inner surfaces of the bag panels. The fastener readily secures to the bag walls between the fastener and bag walls and forms a vacuum tight seal.

According to an example, the fastener, in particular, includes a reclosable fastener for resealably closing a bag with opposing wall panels, each wall panel having an inner surface, the fastener adapted to be affixed to the upper portions of the inner surfaces. The fastener features a first continuous, elongated, profile strip with at least one first hook disposed thereon, the at least one first hook having a half-arrowhead profile being disposed at an end of the profile strip. The fastener also includes a second continuous, elongated, profile strip with at least one first hook having a half-arrowhead profile disposed thereon, the first hook being disposed at an end of the profile strip. Further, the fastener has at least one continuous recess disposed along the length of each of the first and second profile strips, the at least one recess being sized, constructed, and arranged to resealably mate with the first hook on the opposing strip forming an vacuum tight seal and at least one continuous recess on each of the first and second profile strip being dimensioned not to mate with the hooks.

Those of ordinary skill in the art might construe the term "air tight" differently. Webster's Collegiate Dictionary, Tenth Edition, copyright 1997 by Merriam-Webster, Inc., defines "air tight" to mean "impermeable to air, or nearly so." Under such as definition for "air tight," those of ordinary skill in the art might construe an "air tight" seal on a plastic bag to mean a seal that is actually impermeable, or only nearly impermeable to air. Alternatively, persons of ordinary skill might construe an "air tight" reclosable seal to be defined by an industry standard air leak test known as ASTM D3078-02. Under this standard, a bag is submersed in water above which a pressure is applied. Leaks in the bags seal are manifested as air bubbles. As used herein, an "air tight" seal means a seal that will meet the ASTM D3078-02 test. Under the test, an airtight seal would prohibit the transfer of air molecules from the inside to the outside and vice versa, and should be able to keep air molecules in a bag after the seal's closure and air molecules outside the bag after the seal's closure, for as long as the product contained within the bag is expected to be kept reasonably fresh. The term "vacuum tight" as used herein is also defined as at least meeting the "air tight" standard.

DETAILED DESCRIPTION OF THE PRESENT INVENTION

Figure 1:
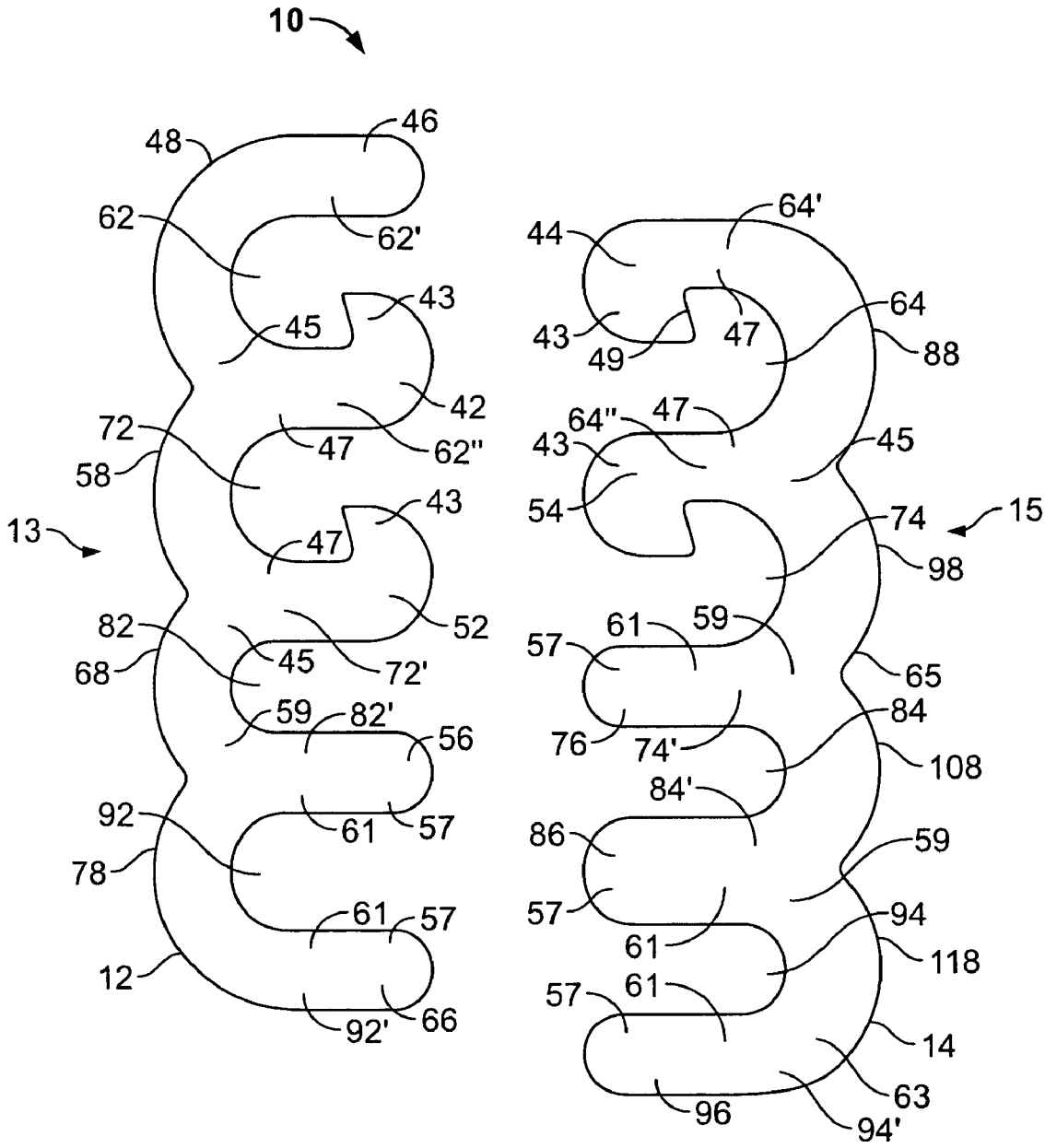
FIG. 1 is a side cross-sectional view of a continuous, profiled, elongated reclosable fastener that is a flanged reclosable fastener.

FIG. 1 shows a continuous, profiled, elongated reclosable fastener 10 according to the present invention. The fastener 10 includes a first continuous elongated profile strip 12 and a second continuous elongated profile strip 14. The fastener 10 is readily secured to the inner surfaces of a bag 16 (FIG. 2) without entrapment of air between the fastener elements and the bag 16. Reclosable plastic containers may be formed utilizing the disclosed fastener.

Figure 2:
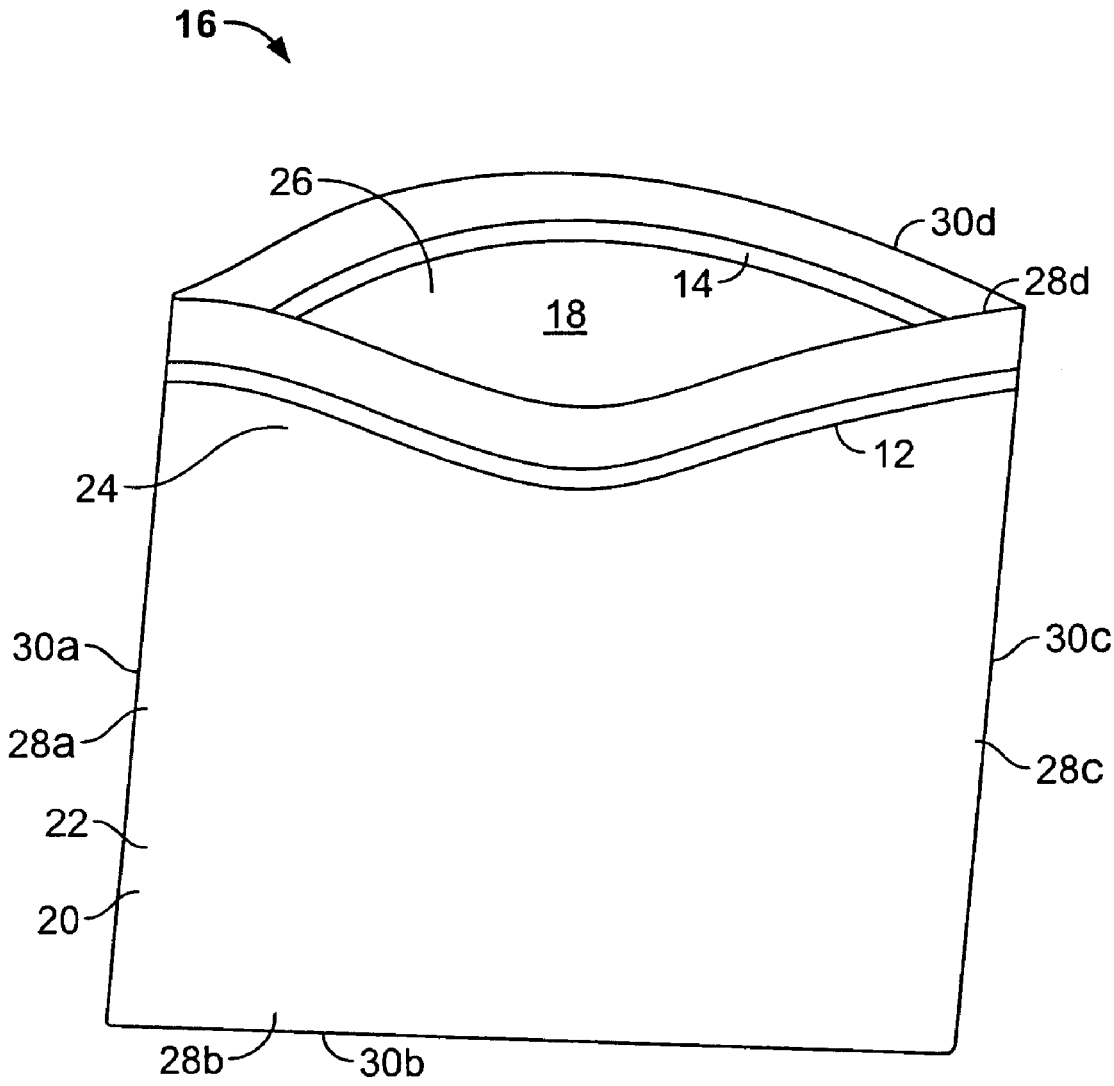
FIG. 2 shows a plastic film bag having reclosable separable fastener structure embodying the present invention.

The bag 16 may be fabricated from any suitable plastic film or sheet material, as is commonly known in the art. The bag 16 has a pouch 18 including opposing wall panels 20, 22 with inner surfaces 24, 26. The wall panels are defined by a first 28*a*, 30*a*, second 28*b*, 30*b*, third 28*c*, 30*c* and fourth 28*d*, 30*d* edges. The bag 16, shown in FIG. 2, is formed by folding a single sheet into two wall panels 20, 22, wherein the side edges of the panels 28*a*, 30*a*, 28*c*, 30*c* may be closed by heat seal. Alternatively, the wall panels 20, 22 may be two separate pieces where the first 28*a*, 30*a*, second 28*b*, 30*b*, and third 28*c*, 30*c* edges are heat sealed to form the pouch 18.

The fourth edges 28*d*, 30*d* provide an access opening to the pouch 18. The profile strips 12, 14 are affixed to the upper portions of the inner surfaces 24, 26 of wall panels 20, 22 to close and seal the bag 16 from the exterior environment. Preferably, the profile strips 12 and 14 are sealed on their rear surface 13 and 15 to inner surfaces 24 and 26 by means of heat sealing. The segments 32, 34 distal to the profile strips 12, 14 act as pull flanges for opening the fastener assembly 10 (FIG. 1).

An important aspect of the invention is the fact that the first continuous elongated profile strip 12 and the second continuous elongated profile strip 14 are configured and arranged to provide a vacuum tight seal upon interconnection thereof. The vacuum tight seal provides the important function of keeping foreign material including bacteria, molds, and viruses from entering the pouch 18. Further, this seal starves any bacteria or other microbes inside the contents of the pouch of oxygen, thus destroying the ability to replicate exponentially. Hence, the risk of contamination of the pouch's contents is greatly reduced. Moreover, the vacuum tight seal provides resistance to inadvertent opening of the seal due to external pressure on the pouch 18 or due to internal pressure from within the pouch 18.

A further advantage of the disclosed examples of FIGS. 1 and 2 is to provide a substantially flangeless reclosable fastener 10 that is both substantially vacuum tight and yet small in size, which reduces plastic usage and cost and allows use of water tight or vacuum tight reclosable fasteners in relatively small flexible containers.

The present inventive reclosable fastener 10 has been found to provide a particularly durable vacuum tight seal. Fastener 10 includes first continuous elongated profile strip 12 and second continuous elongated profile strip 14 each having at least two hooks 42, 52, 44, 54 thereon. First continuous elongated profile strip 12 has hooks 42, 52; second continuous elongated profile strip 14 has hooks 44, 54 hooks thereon. While only two pairs of hooks 42, 52 and 44, 54 are constructed and arranged on the profiles 12, 14 in the variant shown in FIG. 1, it is appreciated that a greater or lesser number of hooks can be used as desired, with a corresponding increase/decrease in width of the strips 12, 14.

Preferably hooks 42, 52 on the first continuous elongated profile strip 12 and hooks 44, 54 on the second continuous, elongated profile 14, as extruded, are of equal height and have a half arrowhead-shaped tip 43, a concave tail 45, and a generally upstanding neck 47 connecting the hip and tail. Hooks 42, 52 are adjacent to each other on the first profile strip 12. Optionally, the hooks 44, 54 on second profile strip 14 are also adjacent to each other in one variant of the invention. At least one hook 44 is at an end of the first continuous elongated profile strip 12. The second hook 54 is located proximal to hook 44. It is appreciated that a hook 44 formed at an end of a profile strip will have a partially-concave tail segment 49.

In one variant of the invention, the first continuous, elongated profile strip 12 has a plurality of continuous recesses 62, 72, 82, 92 along a length of the strip. The second continuous, elongated profile strip 14 has a plurality of continuous recesses 64, 74, 84, 94 along a length of the strip. A plurality of neck segments 62', 62", 72', 82' and 92' are disposed along base segment 64 and define recesses 62, 72, 82 and 92 along the first profile strip 12. Likewise, neck segments 64', 64", 74', 84' and 94' are disposed along base segment 65 and define recesses 64, 74, 84 and 94 along the second profile strip 14. The base segments 63, 65 do not extend beyond the neck segments 62', 92' and 64', 94' located at the opposite ends of each base segment. In other words, the fastener is flangeless; no lateral flanges are used to seal the fastener to the bag wall. Of course, it is appreciated that any number of recesses can be created along the first and second profile strips 12, 14, including but not limited to more than four recesses, with a corresponding increase/decrease in corresponding hooks and other members. In one variant of the invention, at least one of the recesses is dimensioned to resealably mate with one of hooks. The recesses 62, 72 are substantially congruent to hooks 44, 54 such that releasably interlocking the hooks into the recesses creates a secure airtight and watertight seal. Similarly, recesses 64, 74 are substantially congruent to hooks 42, 52 such that releasably interlocking hooks 42, 52 into recesses 64, 74 creates a secure airtight and watertight seal. It is appreciated that the presently disclosed examples provide a reclosable fastener with a plurality of airtight and/or watertight seals between corresponding members of the profile strips 12, 14.

It is further appreciated that, preferably, at least two continuous recesses 62, 72 are dimensioned to resealably mate with hooks 44, 54, and/or at least two continuous recesses 74, 84 are dimensioned to resealably mate with hooks 42, 52.

In another variant of the invention, at least one continuous recess on each respective profile strip is not dimensioned to mate with a respective hook, but rather dimensioned to tightly fit into a recess that is substantially congruent to a profile member. It is appreciated that when member 56 is inserted into recess 84, the tight fit between the member 56 and the recess 84 also creates an additional substantially airtight and watertight seal. The interaction between the other recesses and members causes a similar result with the combination of the interaction of the various hooks, recesses, and members creating a substantially leak-proof failsafe seal. Of course, it is further appreciated that while the geometry of the members as shown in FIG. 1 is of a mono-hooked rib geometry, a variety of geometric configurations can be used, e.g. a rectangular geometry, a triangular geometry, etc. The fastener 10 of the present invention provides for at least one protuberance along a length of each of the first and second profile strips 12, 14 dimensioned to fit securely in one of the continuous recesses on each of the profile strips, and not dimensioned to mate with one of the hooks 42, 52, 44, 54. In the present embodiment, the protuberances 56, 66, 76, 86, 96, as extruded, have a rounded tip 57, a concave tail 59, and a generally upstanding neck 61 connecting the tip and tail. The tip is dimensioned to snuggly communicate with a corresponding recess to add to airtight and watertight qualities of the fastener 10. It is also appreciated that a protuberance 96 formed at the end of a profile strip will have a partially concave tail 63.

As further seen in FIG. 1, a plurality of ridges 48, 58, 68, 78, 88, 98, 108, 118 are located on the back sides of each of the first and second profile strips 12, 14. Ridges 48, 58, 68, 78, 88, 98, 108, 118 provide a suitable way to obtain an airtight and watertight seal of back sides of the first and second profile strips 12, 14 to the inside surfaces 24, 26 (FIG. 2) of panels 20, 22 (FIG. 2).

Figure 3:
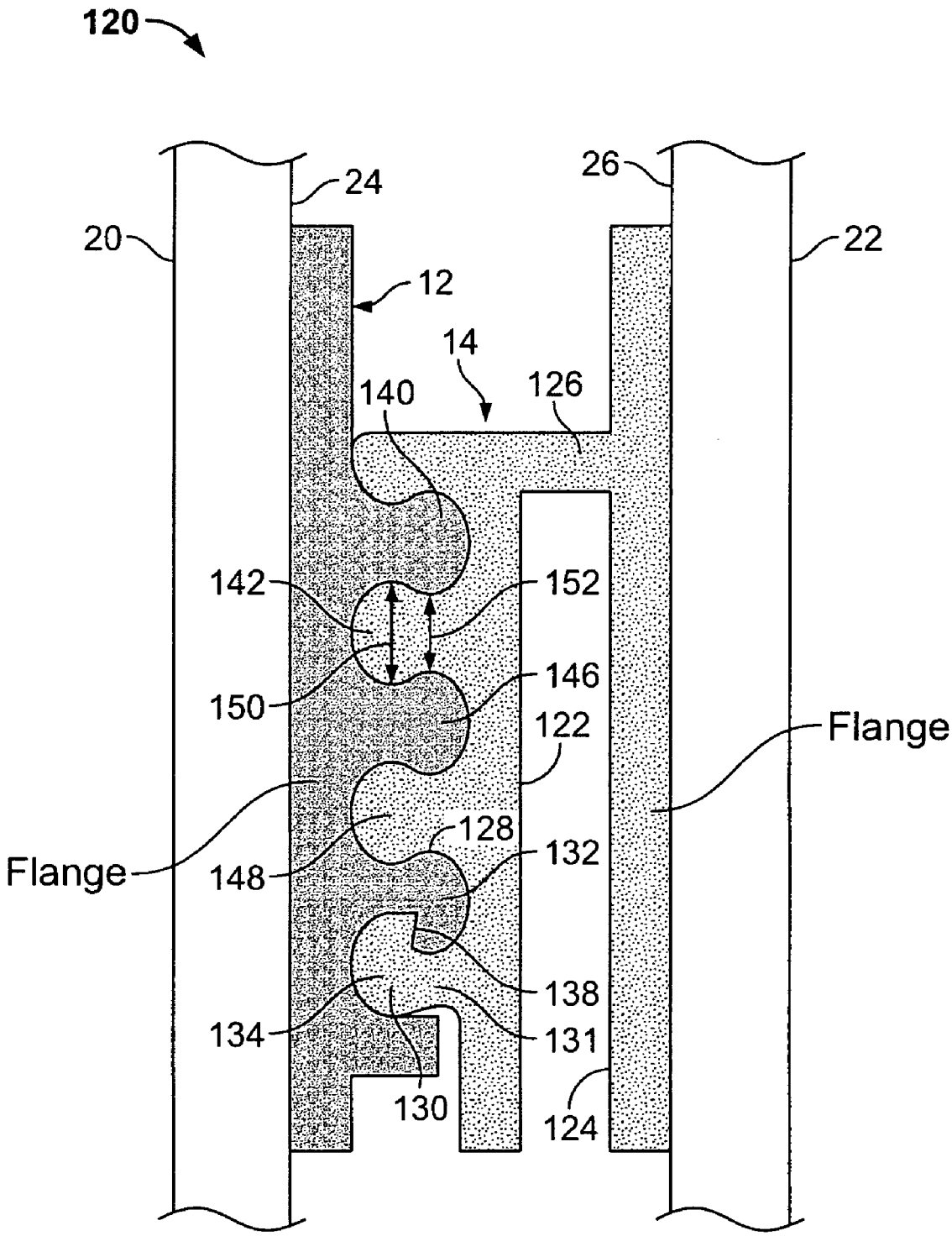
FIG. 3 is a side cross-sectional view of another example of a continuous, profiled, elongated reclosable fastener.

FIG. 3 shows another example of a reclosable fastener strip in accordance with the present invention.

While only a few, preferred embodiments of the invention have been described hereinabove, those of ordinary skill in the art will recognize that the embodiment may be modified and altered without departing from the central spirit and scope of the invention. As illustrated, the fastener strip 120 includes first and second profile strips 12, 14. The elongated profile strips 12 and 14 are respectively affixed to the inner surfaces 24 and 26 of wall panels 20 and 22 to close and seal the bag 16 from the exterior environment. In the illustrated example of FIG. 3, the second continuous elongated profile strip 14, in particular, includes a first portion 122 and a second portion 124 conjoined with a hinge element 126. By inclusion of hinge element 126, further resistance to inadvertent opening of the pouch 18 is afforded. The second portion 124 of the second elongated profile strip 14 is affixed to the inner surface 26.

The first continuous elongated profile strip 12 includes at least one hook element hook 128 and the first portion 122 of the second elongated profile strip 14 also includes a similar hook element 130. Preferably, the hooks 128 and 132 are constrictive in the range of equal height and have a half arrow head-shaped tip 132, 134, respectively. Similar to the similarly described embodiment, corresponding recesses are formed in each of the strips 12 and 14. When the strips 12 and 14 are releasably interlocked, the hook elements 128 and 130 releasably interlock into recesses creating, in conjunction with additional structure to be described below, a vacuum-type seal.

Also illustrated in FIG. 3 are a plurality of continuous recesses on each of the strips 12 and 14, which are not dimensioned to mate with a respective hook, but rather are dimensioned to tightly fit into a corresponding recess that is substantially congruent to a corresponding bulbous profile member and, in particular, to a plurality of bulbous members 140, 142, 146 and 148. When the members 140, 142, 146 and 148 are inserted into a corresponding recess in the opposing strip the resulting type of fit further increases the effectiveness of the seal. In particular, each of the members 140, 142, 146, and 148 have a bulbous shape wherein a dimension of the largest portion of the member (e.g., 150 as illustrated for member 142) is greater than a neck dimension (e.g., dimension 152 of member 142) to create even additional resistance to separation, thereby creating a substantially vacuum tight seal when used in conjunction with the hook elements 128, 130. This interaction of hooks, recesses and bulbous members creates a substantially leak-proof fail safe seal.

Figure 4:
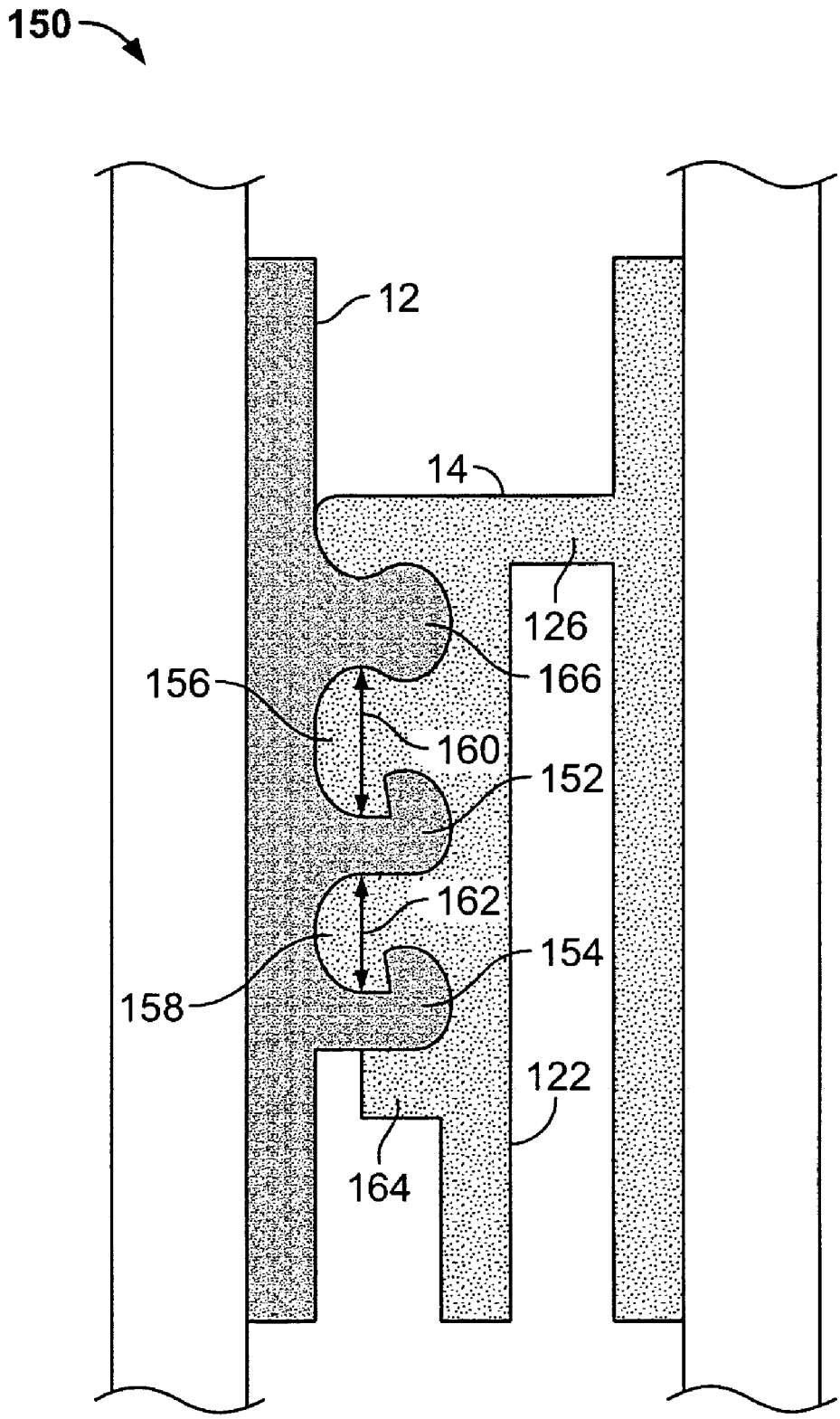
FIG. 4 is a side cross-sectional view of yet another example of a continuous, profiled, elongated reclosable fastener.

FIG. 4 illustrates another example of a hinged geometry having a plurality of hooks and a single bulbous member. In particular, the geometry 150 includes the first elongated profile strip 12 having first and second hooks 152 and 154 and the second profile strip having hooks 156 and 158. It is noted that the hooks may be substantially the same size or, as illustrated, may be dimensioned having different sizes. In particular, FIG. 4 illustrates hook 156 having a longitudinal dimension 160 greater than a longitudinal dimension 162 of hook 158. By including a hook 156 with a larger longitudinal dimension or height, further increased holding force may be effected. Additionally, the first portion 122 of second elongated profile strip 14 may include an extension member 164 showing proper engagement of hook member 154 with the corresponding recess in second elongated profile strip 14 and the member 164 also defining the recess into which hook 154 engages.

Additionally, FIG. 4 illustrates a single bulbous member 166 that interacts with a recess not dimensioned to mate with a hook, but rather with member 166, the recessed beam defined by the first portion 122 of second elongated profile strip 14.

Figure 5:
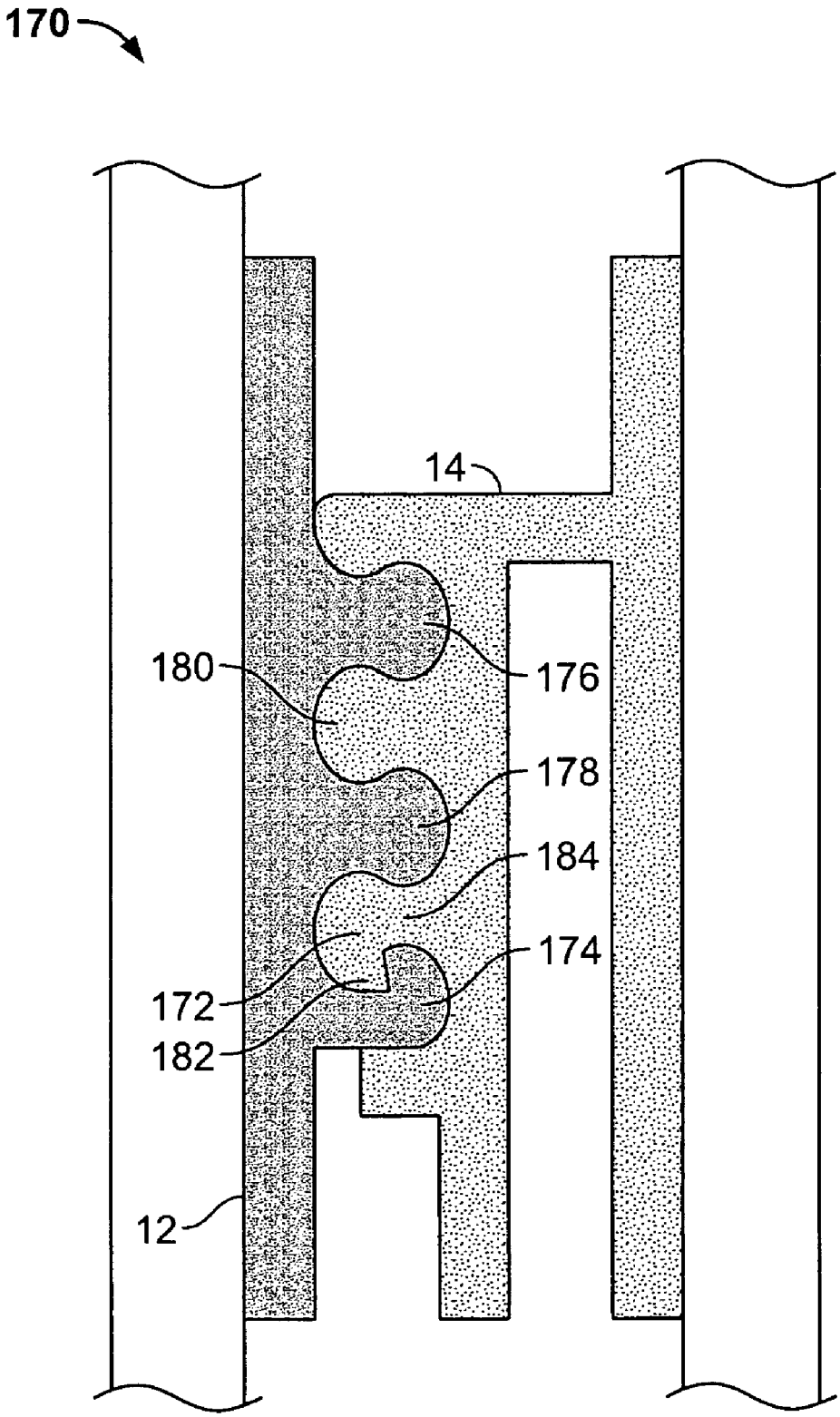
FIG. 5 is a side cross-sectional view of still another example of a continuous, profiled, elongated reclosable fastener.

FIG. 5 illustrates yet another embodiment of a fastener 170 that includes a single hook 172, 174, formed in each of profile strips 12 and 14, respectively. Additionally, two bulbous members 176 and 178 are defined in first elongated profile strip 12 that mate with a respectively shaped recess within the second elongated profile strip 14. However, the second elongated profile strip 14 includes one bulbous member 180, which engages with a correspondingly shaped recess defined in strip 12. It is noted that FIG. 5 illustrates an example of a fastener 170 that utilizes less longitudinal distance than the fastener 120 of FIG. 3, additionally, the half arrowhead-shaped hook 172 has a tail portion 182 oriented downward to be lower than a neck portion 184 of the hook 172. In contrast, the fastener 120 of FIG. 3 includes the profile strip 14 having hook 130 with a tail portion oriented upward or above a neck portion 131 of the hook 130. It is noted that either orientation of the hooks may be contemplated.

Figure 6:
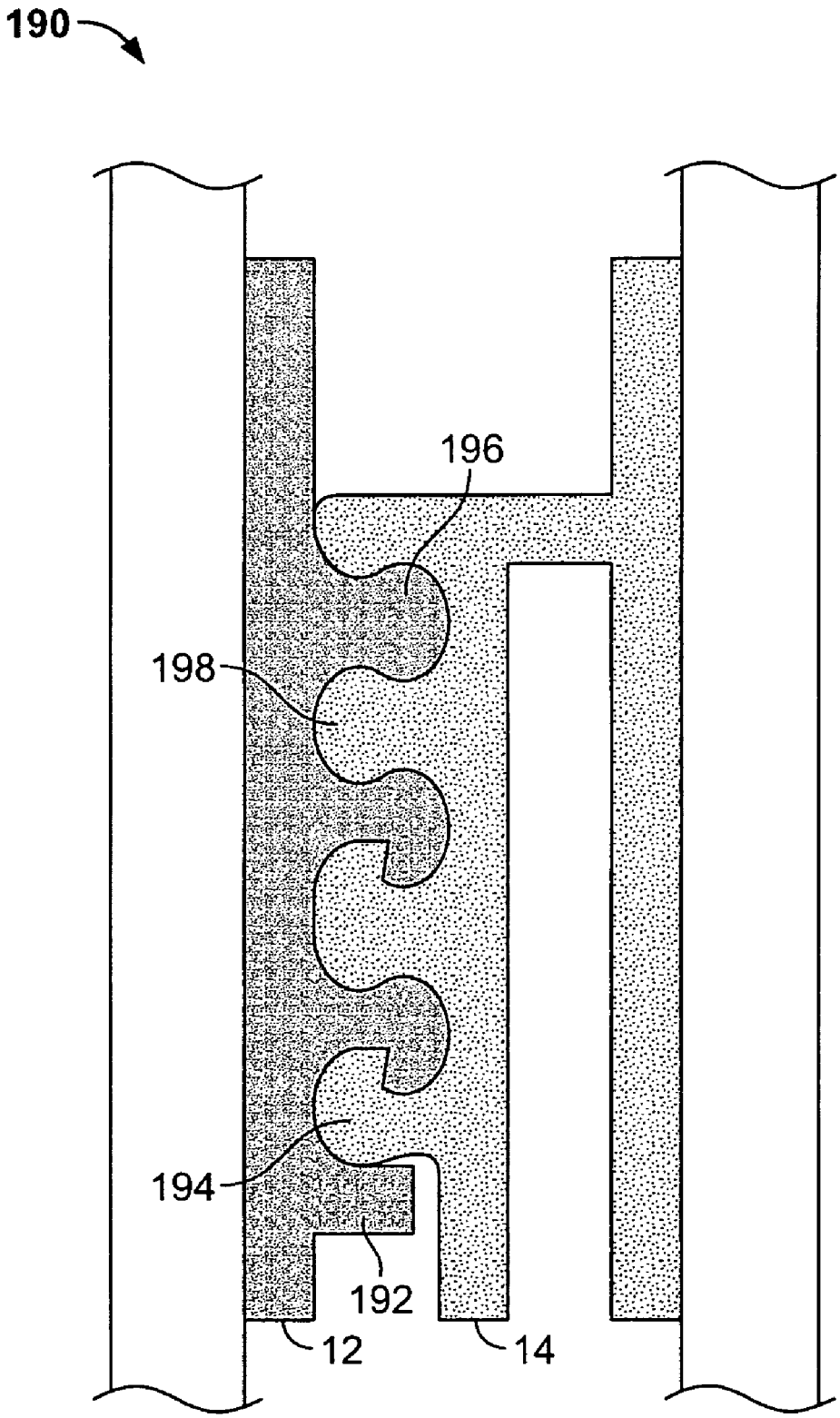
FIG. 6 is a side cross-sectional view of yet still another example of a continuous, profiled, elongated reclosable fastener

FIG. 6 illustrates yet another fastener 190, including the strips 12 and 14 having a plurality of hooks, which may be dimensioned either the same or different, as illustrated. Additionally, the fastener 190 of FIG. 6 features the first elongated strip 12 having an extended member 192 at a bottom portion of the strip 12 to define a recess into which a hook 194 of strip 14 is inserted during releasable sealing of strips 12 and 14. Additionally, the example of FIG. 6 demonstrates a geometry where each of the strips 12 and 14 include a respective bulbous member 196 and 198.

In light of foregoing, the preferred embodiments described are to be considered in all respects as illustrative and not restrictive, the scope of the invention being indicated by the appended claims, rather than by the foregoing description, and all changes which come within the meaning and range of equivalency of the claims are intended to be embraced herein.

It is appreciated that while the geometry and arrangement of the various recesses, bulbs and hooks described herein generally relate to a hook and a substantially congruent recess to the hook configured, sized, constructed and arranged for creating a vacuum tight seal, a variety of suitable geometries or configurations of the male members and female members are disclosed subject only to the condition that the seal made when the profiles are interlocked is vacuum tight.

What is claimed is:

1. A reclosable fastener for resealably closing a bag with opposing wall panels, each wall panel having an inner surface, the fastener adapted to be affixed to the upper portions of the inner surfaces, the fastener comprising:

a first continuous, elongated, profile strip with at least one first hook disposed thereon, the at least one first hook having a half-arrowhead profile being disposed at an end of the profile strip;

a second continuous, elongated, profile strip with at least one first hook having a half-arrowhead profile disposed thereon, the first hook being disposed at an end of the profile strip; the second continuous elongated, profile strip includes a first portion and a second portion conjoined with a hinge element for preventing inadvertent opening of the bag; and at least one continuous recess disposed along the length of each of the first and second profile strips, the at least one recess being sized, constructed and arranged to resealably mate with the first hook on the opposing strip and form a vacuum tight seal and at least one continuous recess on each of the first and second profile strips dimensioned to be incapable of mating with the hooks.

2. The reclosable fastener of claim 1, wherein at least two of the continuous recesses are dimensioned to resealably mate with the hooks.

3. The reclosable fastener of claim 2, further comprising at least one bulbous protuberance along a length of each of the first and second profile strip and dimensioned to fit securely in the continuous recess on each of the first and second profile strips dimensioned to be incapable of mating with the hooks.

4. The reclosable fastener of claim 3, wherein the hooks are substantially distributed on a side of a center axis of the profile strip.

5. The reclosable fastener of claim 4, wherein the hooks are mono-hooked ribs of equal height.

6. The reclosable fastener of claim 1, wherein the at least one first hook has a half-arrowhead-shaped hook with a tail portion oriented toward a neck portion of the hook.

7. The reclosable fasteners of claim 1, wherein an extension member provides proper engagement of the first hook member with a corresponding recess by defining at least the recess into which the first hook engages, said extension member attached to a profile strip opposed to the profile strip having a hook with a half-arrowhead.

8. A plastic film bag comprising opposing wall panels, each wall panel comprising an inner surface and a first, second, third and fourth edge, wherein the wall panels are attached along the first, second and third edges, and a reclosable fastener is affixed to the inner surfaces at about the fourth edges of the wall panels and approximately parallel to the fourth edges of the wall panels, the reclosable fastener comprising:

a first continuous, elongated, profile strip with at least a first and second hook having a half-arrowhead profile disposed thereon, the first hook being disposed at an end of the profile strip;

a second continuous, elongated, profile strip with at least one first hook disposed thereon, the first hook being disposed at an end of the profile strip; and a plurality of continuous recesses disposed along the length of each of the first and second profile strips, at least one of the recesses being dimensioned to resealably mate with and is substantially congruent to the first hook on the opposing strip forming a vacuum tight seal and at least one continuous recess on each of the first and second profile strips being dimensioned to be incapable of mating with the hooks.

9. The reclosable fastener of claim 8, wherein said first and second elongated profile strips are substantially without lateral sealing flanges.

10. The plastic film bag of claim 9, wherein at least two of the continuous recesses on the reclosable fastener are dimensioned to resealably mate with the hooks.

11. The reclosable fastener of claim 8, wherein the at least one first hook has a half-arrowhead-shaped hook with a tail portion oriented toward a neck portion of the hook.

12. The reclosable fasteners of claim 8, wherein an extension member provides proper engagement of the first hook member with a corresponding recess by defining at least the recess into which the first hook engages, said extension member attached to a profile strip opposed to the profile strip having a hook with a half-arrowhead.

13. A reclosable fastener for resealably closing a bag with opposing wall panels, each wall panel having an inner surface, the fastener adapted to be affixed to the upper portions of the inner surfaces, the fastener comprising:

a first continuous, elongated, profile strip with at least one first hook disposed thereon, the at least one first hook having a half-arrowhead profile being disposed at an end of the profile strip;

a second continuous, elongated, profile strip with at least one first hook having a half-arrowhead profile disposed thereon, the first hook being disposed at an end of the profile strip;

at least one continuous recess disposed along the length of each of the first and second profile strips, the at least one recess being configured to resealably mate with and is substantially congruent to the first hook on the opposing strip and at least one continuous recess on each of the first and second profile strips dimensioned to be incapable of main with the hooks; and at least one bulbous shaped protuberance along a length of at least one of the first and second profile strip and dimensioned to fit securely in one of the continuous recess on each of the first and second profile strips dimensioned to be incapable of mating with the hooks.

14. The plastic film bag of claim 13, wherein the reclosable fastener further comprises at least one bulbous shaped protuberance along a length of each of the first and second profile strips and dimensioned to fit securely in the continuous recess on each of the first and second profile strips dimensioned to be incapable of mating with the hooks.

15. The plastic film bag of claim 14, wherein the reclosable fastener further comprises a plurality of ridges on a back side of each of the first and second profile strips providing an airtight and watertight seal of the back sides of the first and second profile strips to the inner spaces of the panels.

16. The plastic film bag of claim 15, wherein at least one of the hooks on the first profile strip is located near the center of the profile strip.

17. The plastic film bag of claim 16, wherein the hooks are mono-hooked ribs of equal height.

18. The reclosable fastener of claim 13, wherein at least two of the continuous recesses are dimensioned to resealably mate with the hooks.

19. The reclosable fastener of claim 18, wherein the combination of the hooks and the at least one bulbous shaped protuberance form an vacuum tight seal.

20. The reclosable fastener of claim 18, wherein the hooks are substantially distributed on a side of a center axis of the profile strip.

21. The reclosable fastener of claim 18, wherein the hooks are mono-hooked ribs of equal heights.

22. The reclosable fastener of claim 18, wherein the hooks are mono-hooked ribs of differing heights.

23. The reclosable fastener of claim 13, wherein the at least one first hook has a half-arrowhead-shaped hook with a tail portion oriented toward a neck portion of the hook.

24. The reclosable fasteners of claim 13, wherein an extension member provides proper engagement of the first hook member with a corresponding recess by defining at least the recess into which the first hook engages, said extension member attached to a profile strip opposed to the profile strip having a hook with a half-arrowhead.

25. A reclosable fastener for resealably closing a bag with opposing wall panels, each wall panel having an inner surface, the fastener adapted to be affixed to the upper portions of the inner surfaces, the fastener comprising:

a first continuous, elongated, profile strip with at least one first hook disposed thereon, the at least one first hook having a half-arrowhead profile being disposed at an end of the profile strip;

a second continuous, elongated, profile strip with at least one first hook having a half-arrowhead profile disposed thereon, the first hook being disposed at an end of the profile strip;

a plurality of continuous recesses disposed along the length of each of the first and second profile strips, each of the plurality being sized, constructed and arranged to resealably mate with the first hook on the opposing strip wherein the first hook is substantially congruent to the continuous recesses and at least one continuous recess on each of the first and second profile strips dimensioned to be incapable of mating with the hooks; and a plurality of bulbous shaped protuberances along a length of at least one of the first and second profile strip and dimensioned to fit securely in one of the plurality of continuous recesses on each of the first and second profile strips dimensioned to be incapable of mating with the hooks effective to provide a vacuum tight seal.

26. The reclosable fastener of claim 25, wherein at least two of the plurality of continuous recesses are dimensioned to resealably mate with the hooks.

27. The reclosable fastener of claim 25, wherein the hooks are substantially distributed on a side of a center axis of the profile strip.

28. The reclosable fastener of claim 25, wherein the hooks are mono-hooked ribs of equal height.

29. The reclosable fastener of claim 25, wherein the hooks are mono-hooked ribs of differing heights.

30. The reclosable fastener of claim 25, wherein the at least one first hook has a half-arrowhead-shaped hook with a tail portion oriented toward a neck portion of the hook.

31. The reclosable fasteners of claim 25, wherein an extension member provides proper engagement of the first hook member with a corresponding recess by defining at least the recess into which the first hook engages, said extension member attached to a profile strip opposed to the profile strip having a hook with a half-arrowhead.

* * * * *